US007671707B2

(12) United States Patent
Ohwada et al.

(10) Patent No.: US 7,671,707 B2
(45) Date of Patent: Mar. 2, 2010

(54) BANDSTOP FILTER HAVING A MAIN LINE AND ¼ WAVELENGTH RESONATORS IN PROXIMITY THERETO

(75) Inventors: Tetsu Ohwada, Tokyo (JP); Hiroshi Osakada, Tokyo (JP); Hideyuki Oh-Hashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 130 days.

(21) Appl. No.: 10/558,781

(22) PCT Filed: Jul. 30, 2003

(86) PCT No.: PCT/JP03/09674

§ 371 (c)(1),
(2), (4) Date: Nov. 30, 2005

(87) PCT Pub. No.: WO2005/013411

PCT Pub. Date: Feb. 10, 2005

(65) Prior Publication Data

US 2006/0250199 A1 Nov. 9, 2006

(51) Int. Cl.
*H01P 1/203* (2006.01)

(52) U.S. Cl. ..... 333/204; 333/219

(58) Field of Classification Search ..... 333/204, 333/219

See application file for complete search history.

(56) References Cited

U.S. PATENT DOCUMENTS 5,192,927 A * 3/1993 Lin ..... 333/204

OTHER PUBLICATIONS

B. M. Schiffman et al., IEEE Trans, on Microwave Theory and Techniques. vol. MTT-12, pp. 6-15, Jan. 1964.
Microfilm of the specification and drawings annexed to the request of Japanese Utility Model Application No. 36680/1982 (Laid-open No. 139704/1983) Sep. 20, 1983.
Microfilm of the specification and drawings annexed to the request of Japanese Utility Model Application No. 119887/1989 (Laid-open No. 59706/1991) Jun. 12, 1991.

* cited by examiner

*Primary Examiner*—Benny Lee
(74) *Attorney, Agent, or Firm*—Birch, Stewart, Kolasch, & Birch, LLP.

(57) ABSTRACT

A bandstop filter where variation in characteristics is suppressed to minimum and which realizes an increased production yield. The physical length of a line joint portion between a main line and an oscillator can be enlarged by providing an impedance non-continuous structure portion in a strip conductor of the oscillator. In comparison to the case where the impedance non-continuous structure portion is not provided, the width of a joint slit required to obtain an equal joint amount can be enlarged. When the joint slit width is enlarged, variation in filter characteristics caused by pattern accuracy can be reduced because of the enlarged joint slip width, thus improving a filter yield. This means that pattern accuracy requirement for production is loosened. Freedom in selecting a dielectric substrate is increased, which also provides an advantage that a filter can be produced using a less expensive dielectric substrate with not very high pattern accuracy.

5 Claims, 7 Drawing Sheets

BANDSTOP FILTER HAVING A MAIN LINE AND ¼ WAVELENGTH RESONATORS IN PROXIMITY THERETO

BACKGROUND OF THE INVENTION

1. Field of the Invention

The present invention relates to a high-frequency filter used in a microwave band and a millimeter-wave band.

2. Description of the Related Art

With a bandstop filter described in a document entitled "Exact Design of Band-stop Microwave Filters" (written by B. M. Schiffman and G. L. Matthaei in IEEE Trans. on MTT, vol. MTT-12, pp 6-15 (1964)), for instance, by reflecting a signal in a frequency band in which the electrical length of an inner conductor of a resonator becomes approximately 90 degrees, passage of the signal in the frequency band is inhibited.

In the case of this bandstop filter, a frequency, at which the resonator resonates, becomes the center frequency of a stop band. Also, a gap of a portion, in which the inner conductor of the resonator and an inner conductor of a main line are arranged parallel to each other and constitute a line joint, corresponds to the stop bandwidth of the filter. That is, there is a property with which it is possible to enlarge the stop bandwidth by enlarging the joint between the resonator and the main line through reduction of the gap of the line joint portion.

Further, the joint between the resonator and the main line described above becomes the maximum when the electrical length in the line joint portion at the center frequency of the stop band is 90 degrees. That is, when it is desired to secure a predetermined joint amount between the main line and the resonator in the case where the electrical length in the line joint portion at the center frequency of the stop band is smaller than 90 degrees, it is required to reduce the gap of the line joint portion likewise.

However, the conventional technique has the following problems. The size of the gap of the line joint portion described above depends on the kind of the line constituting the filter. In addition, because of the producible minimum size, production errors, and the like, it is not guaranteed that the size of the gap necessarily becomes a desired size. This imposes a limitation on the stop bandwidth that is realizable with a produced filter.

In particular, when the conventional bandstop filter is constructed using a planar circuit such as a microstrip line or a strip line, there arise the following problems. That is, a strip conductor corresponding to the inner conductor described above has an extremely thin thickness, which makes it more difficult to obtain a large joint. When a gap for realizing a desired stop bandwidth is reduced and approaches a limitation in terms of production, a problem of variation in gap due to a production error or variation in width due to a production error of two strip conductors becomes more prominent. As a result, variation in characteristics due to the variation leads to variation in stop band frequency. However, it is difficult to adjust the distance between the strip conductors after formation because they are formed through etching or the like. Therefore, the variation in characteristics due to the production error directly leads to a filter yield reduction.

In addition, the conventional bandstop filter has a problem in that a production error in short-circuiting means of the resonator directly leads to variation in filter characteristics. In particular, when the filter is constructed using a planar circuit such as a microstrip line, the short-circuiting means is formed using a through hole or a via hole. In such a case, there is a problem in that when the positional relation between the strip conductor and the through hole (via hole) changes due to a problem in terms of production, a resonance frequency is shifted and there occurs characteristic deterioration such as variation in stop band.

SUMMARY OF THE INVENTION

The present invention has been made to solve the above problems, and has an object to provide a bandstop filter with which variation in characteristics is suppressed to minimum and a production yield is improved.

A bandstop filter according to the present invention includes: a main line connecting an input terminal and an output terminal to each other; and a ¼ wavelength resonator arranged in proximity to the main line approximately parallel to the main line with a distance of an approximately ¼ wavelength, in which the ¼ wavelength resonator includes a first impedance non-continuous structure portion and divides a line section that is approximately parallel to the main line into portions having different characteristic impedances.

BRIEF DESCRIPTION OF THE DRAWINGS

Various exemplary embodiments of this invention will be described in detail with reference to the following figures, wherein like numerals represent like elements, and each construction element of the first resonator is given a reference numeral with a suffix "a" and suffixes "b" and "c" are used for the second and third resonators in a like manner. Note that in the following description, when an explanation that is common to the three resonators is made, only reference numerals, from which the suffixes are removed, are used.

DESCRIPTION OF THE PREFERRED EMBODIMENTS

Hereinafter, embodiments of the present invention will be described with reference to the drawings.

First Embodiment

Figure 1:
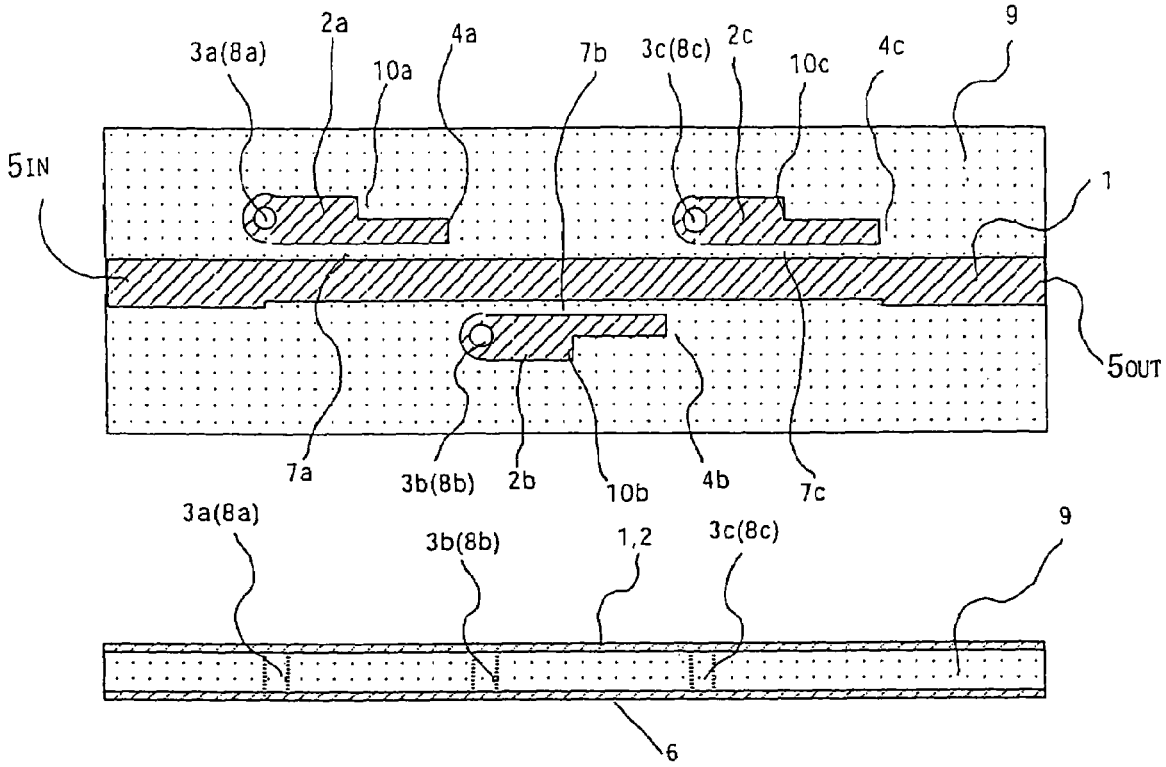
FIG. 1 is an internal construction diagram of a bandstop filter according to a first embodiment of the present invention.

FIG. 1 is an internal construction diagram of a bandstop filter according to the first embodiment of the present invention, with a view from above and a cross-sectional view being illustrated. In FIG. 1, a bandstop filter including three resonators is illustrated.

The bandstop filter of the first embodiment is a three-stage filter having a microstrip line structure constructed using one dielectric substrate 9. An input signal to be bandstopped is taken into the bandstop filter from an input terminal $\mathbf{5}_{IN}$, passes through a strip conductor 1 of a main line, and is finally outputted as a bandstopped signal from an output terminal $\mathbf{5}_{OUT}$. There are strip conductors 2*a*, 2*b* and 2*c* (hereinafter generally designated as conductor 2) of resonators in three stages arranged approximately parallel to the strip conductor 1 of the main line by corresponding joint slits 7*a*, 7*b* and 7*c* (hereinafter generally designated as slit 7) and provides bandstopping to be described in detail later is performed through operations thereof.

The bandstop filter of the first embodiment is constructed using a microstrip line structure including an earth conductor 6 on one main surface of the dielectric substrate 9 and including the strip conductor 1 of the main line and the strip conductors 2*a*, 2*b* and 2*c* of the resonators on the other main surface. The strip conductors 2*a*, 2*b* and 2*c* of the resonators includes respective open end 4*a*, 4*b* and 4*c* and corresponding opposite end which is short-circuited with the earth conductor 6 by respective short-circuiting means 3*a*, 3*b* and 3*c* through corresponding through holes 8*a*, 8*b* and 8*c*.

Figure 2:
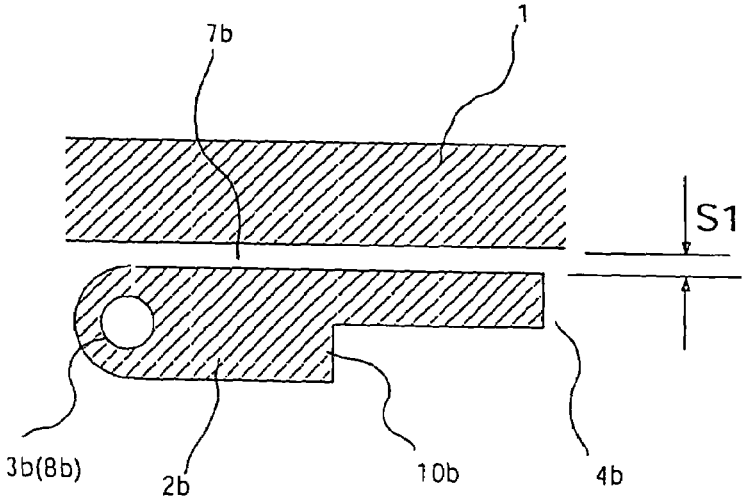
FIG. 2 is an enlarged view of a resonator in the second stage of the bandstop filter according to the first embodiment of the present invention.

FIG. 2 is an enlarged view of the resonator in the second stage of the bandstop filter according to the first embodiment of the present invention. The short-circuiting means 3*b* for short-circuiting between the strip conductor 2*b* of the resonator and the earth conductor 6 is arranged at one end of the strip conductor 2*b* of the resonator. On the other hand, the other end of the strip conductor 2*b* of the resonator is set as an open end 4*b*. Also, the strip conductor 1 of the main line and the strip conductor 2*b* of the resonator are placed under a positional relation in which they are approximately parallel to each other with a distance corresponding to a gap of a joint slit 7*b* that is a gap between the strip conductor 1 and the strip conductor 2*b*. In FIG. 2, the gap of the joint slit 7*b* is expressed as "S1".

Further, the strip conductor 2*b* of the resonator has an impedance non-continuous structure portion 10*b*. By reducing the width of the strip conductor 2*b* of the resonator in a section from the impedance non-continuous structure portion 10*b* to the open end 4*b*, the impedance in this section is increased.

Figure 3:
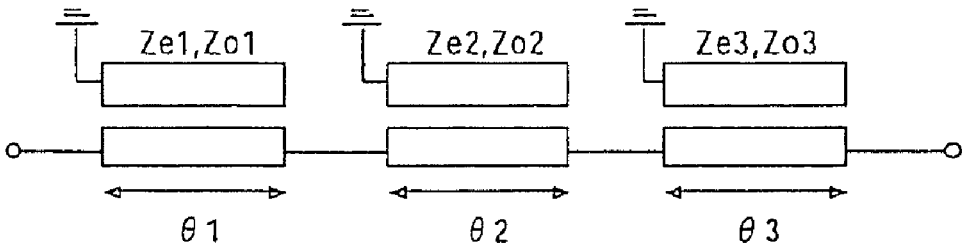
FIG. 3 is an equivalent circuit diagram of the bandstop filter according to the first embodiment of the present invention.

FIG. 3 is an equivalent circuit diagram of the bandstop filter according to the first embodiment of the present invention. The even mode impedance, odd mode impedance, and electrical length of the line joint of each resonator are generally expressed as "Ze", "Zo", and "θ", respectively followed by a numbered suffix (i.e., 1, 2, 3 . . . ) for the corresponding resonator.

Figure 4:
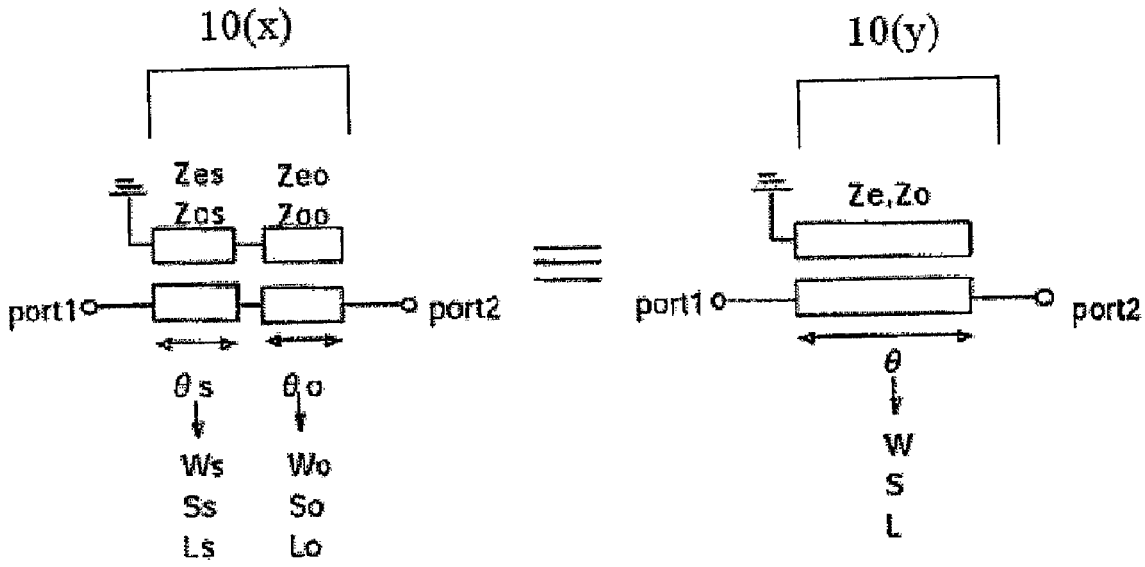
FIG. 4 is a circuit diagram for explanation of design of a resonator portion of the bandstop filter according to the first embodiment of the present invention.
Figure 5:
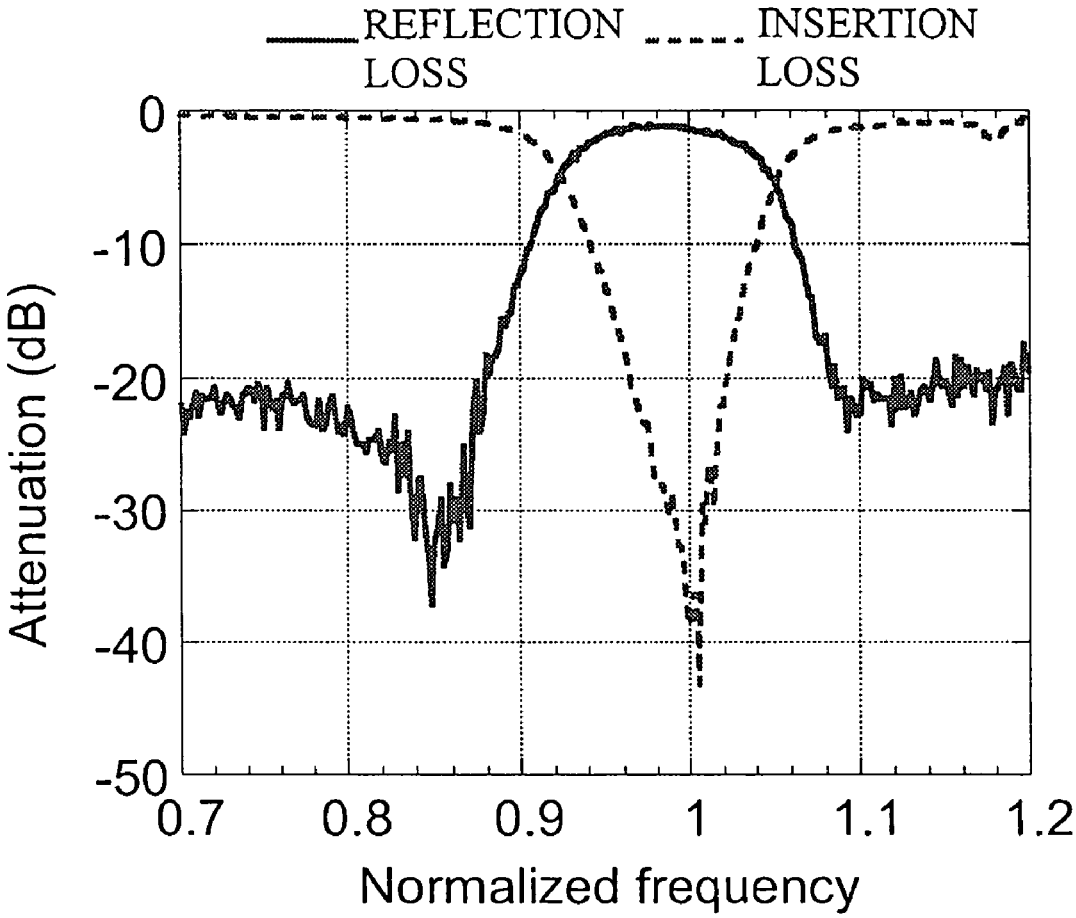
FIG. 5 shows the reflection characteristic and transmission characteristic of the bandstop filter according to the first embodiment of the present invention.

Also, FIG. 4 is a circuit diagram for explanation of design of the resonator portion of the bandstop filter according to the first embodiment of the present invention, with the illustrated circuit diagram corresponding to one resonator. The ports that electronically connects the resonator to the lines joints are labeled Port 1 and Port 2. Further, FIG. 5 shows the reflection loss characteristic and insertion loss characteristic of the bandstop filter according to the first embodiment of the present invention.

Next, an operation of the bandstop filter will be briefly described with reference to these drawings. At the first resonator in FIG. 1, among high-frequency signals inputted from the input terminal $\mathbf{5}_{IN}$, a signal at a frequency at which the electrical length of the strip conductor 2*a* of the resonator becomes sufficiently smaller than 90 degrees, that is, a frequency, at which the electrical length of the strip conductor 2*a* of the resonator becomes sufficiently smaller than a ¼ wavelength, is transferred to the resonator in the next stage (or an output terminal $\mathbf{5}_{OUT}$ side) almost as it is. In the case of the equivalent circuit diagram in FIG. 3, a frequency band, in which the electrical length θ1 becomes sufficiently smaller than 90 degrees, corresponds to this. This phenomenon is due to the following reason. Because of the existence of the resonator, a shunt capacity is added to the main line. As shown in FIG. 1, a portion of the strip conductor 1 of the main line that faces the strip conductor 2*a* of the resonator with a joint slit 7*a* in-between is adjusted so that it assumes an impedance that is slightly higher than the design impedance (terminal condition) of the filter. Consequently, a slight series inductance is exhibited, so through combination of the shunt capacity and the series inductance, impedance matching analogous to the frequency band of the pass band of a low pass filter is performed.

Also, among the high-frequency signals inputted from the input terminal 5N, a signal at a frequency at which the electrical length of the strip conductor 2*a* of the resonator becomes approximately 90 degrees, that is, a frequency, at which the electrical length of the strip conductor 2*a* of the resonator becomes approximately a ¼ wavelength, is trapped in the resonator because the resonator resonates. Then, almost all of energy of the signal other than a part of the energy dissipated due to a loss in the resonator is reflected toward the input terminal $\mathbf{5}_{IN}$. For a circuit, the shunt capacity added to the main line through the existence of the resonator becomes extremely large and a state is obtained in which the main line is short-circuited or is nearly short-circuited in a portion on a short-circuiting means 3*a* side of the joint slit 7*a* in which the strip conductor 1 of the main line and the strip conductor 2*a* of the resonator face each other in parallel. Consequently, almost all of the energy is reflected (see FIG. 5).

Further, among the high-frequency signals inputted from the input terminal $\mathbf{5}_{IN}$, a signal at a frequency at which the electrical length of the strip conductor 2*a* of the resonator becomes sufficiently larger than 90 degrees, that is, a frequency, at which the electrical length of the strip conductor 2*a* of the resonator becomes sufficiently larger than a ¼ wavelength, is transferred to the resonator in the next stage (or the output terminal $\mathbf{5}_{OUT}$ side) almost as it is. In the case of the equivalent circuit diagram in FIG. 3, a frequency band, in which the electrical length θ1 becomes sufficiently larger than 90 degrees, corresponds to this. This phenomenon is due to the following reason. The resonator is arranged parallel to the main line and the electrical length of the resonator is larger than 90 degrees, so a state is obtained in which a shunt inductance is added to the main line. In addition, a portion of the strip conductor 1 of the main line that faces the strip conductor 2*a* of the resonator with the joint slit 7*a* in-between is adjusted so that it has an electrical length, which is larger than 90 degrees, and assumes an impedance that is slightly higher than the design impedance (terminal condition) of the filter. Consequently, an electrical condition that is analogous to a series arrangement of capacitances is obtained and through combination of the shunt inductance and the series capacitance, impedance matching analogous to the frequency band of the pass band of a high pass filter is performed. Therefore, most of the energy of the inputted signal is transferred to the resonator in the next stage (or the output terminal $\mathbf{5}_{OUT}$ side).

In addition, the bandstop filter according to the first embodiment of the present invention as shown in FIG. 1 is characterized in that the resonator is provided with the respective impedance non-continuous structure portions 10*a*, 10*b* and 10*c* (hereinafter designated as non-continuous structure portion 10(*x*)). With this characteristic construction, it becomes possible to enlarge the physical length of the resonator and also enlarge the joint slit 7 as compared with a case where the resonator does not include the impedance non-continuous structure portion 10(*y*).

Next, how the physical dimensions of the resonator and the physical dimensions of the joint portion structure between the main line and the resonator of the bandstop filter in the first embodiment of the present invention are designed will be described.

In FIG. 4, an equivalent circuit when the resonator includes the impedance non-continuous structure portion 10(*x*) is illustrated on the left side and an equivalent circuit when the resonator does not include the impedance non-continuous structure portion 10(*y*) is illustrated on the right side. In design of the resonator in the bandstop filter including the main line portion, dimensional parameters are selected so that the equivalent circuit when the resonator including the impedance non-continuous structure portion 10(*y*) is used and the equivalent circuit when the resonator not including the impedance non-continuous structure portion 10(*y*) is used become electrically equivalent to each other at the center frequency of the stop band. In FIG. 4, the strip conductor width is expressed as "W", the joint slit width is expressed as "S", the physical length is expressed as "L", the line joint even mode impedance is expressed as "Ze", the odd mode impedance is expressed as "Zo", and the electrical length is expressed as "θ". Also, in the circuit diagram on the left side of FIG. 4, a suffix "s" of reference symbols indicates a circuit corresponding to a short-circuiting means 3*b* side with reference to the impedance non-continuous structure portion 10*b* in FIG. 2 and a suffix "o" of the reference symbols indicates a circuit corresponding to an open end 4*b* side with reference to the impedance non-continuous structure portion 10*b* in FIG. 2. Further, the circuit illustrated on the right side of FIG. 4 is a circuit uniquely given through designation of the filter bandwidth, the number of stages, the reflection loss in the pass band, and the like based on a certain procedure described in the document described above or the like.

The resonator including the impedance non-continuous structure portion 10(*x*) is referred to as the "stepped impedance resonator" and is often used as means for miniaturization of the resonator or the like. In the first embodiment, in a ¼ wavelength resonator whose one end is short-circuited and other end is opened, the impedance of the line on the open end 4 side is set higher than the impedance of the line on the short-circuiting means 3 side by the impedance non-continuous structure portion 10(*y*). Therefore, it becomes possible to enlarge the physical length of the resonator with respect to a resonance frequency from the physical length thereof with respect to the resonance frequency in a case where the impedance non-continuous structure portion 10(*y*) is not included. That is, by providing the impedance non-continuous structure portion 10(*x*), it becomes possible to enlarge the physical length of the line joint portion constructed between the main line and the resonator.

The joint amount of the line joint constructed between the main line and the resonator fundamentally has a relation in which it is proportional to the physical length of the line joint portion and is inversely proportional to the width of the joint slit 7. Accordingly, when a desired joint amount between the main line and the resonator is secured, it is possible to enlarge the width of the joint slit 7 by enlarging the physical length of the line joint portion through provision of the impedance non-continuous structure portion 10(*y*). That is, the parameters of the physical dimensions in FIG. 4 have relations "(Ls+Lo)>L, Ss=So>S".

As described above, by providing the impedance non-continuous structure portion 10 for the strip conductor 2 of the resonator, it becomes possible to enlarge the physical length of the line joint portion between the main line and the resonator. As a result, it becomes possible to enlarge the width of the joint slit 7 (corresponding to S1 in FIG. 2) for obtainment of an equal joint amount as compared with a case where the impedance non-continuous structure portion 10(*y*) is not provided. Consequently, with the bandstop filter of the first embodiment, an effect is provided that it is possible to realize a filter with a large stop bandwidth, which requires an enlarged joint amount, under a state where the width of the joint slit 7 is enlarged as compared with a conventional case. In addition, the enlargement of the width of the joint slit 7 makes it possible to reduce variation in filter characteristics caused by pattern accuracy, which provides an effect that a filter production yield is improved. This corresponds to looseness of a pattern accuracy requirement for production and flexibility in selection of a dielectric substrate is increased, which brings about an advantage that it is possible to produce a filter using an inexpensive dielectric substrate with not very high pattern accuracy.

Second Embodiment

Figure 6:
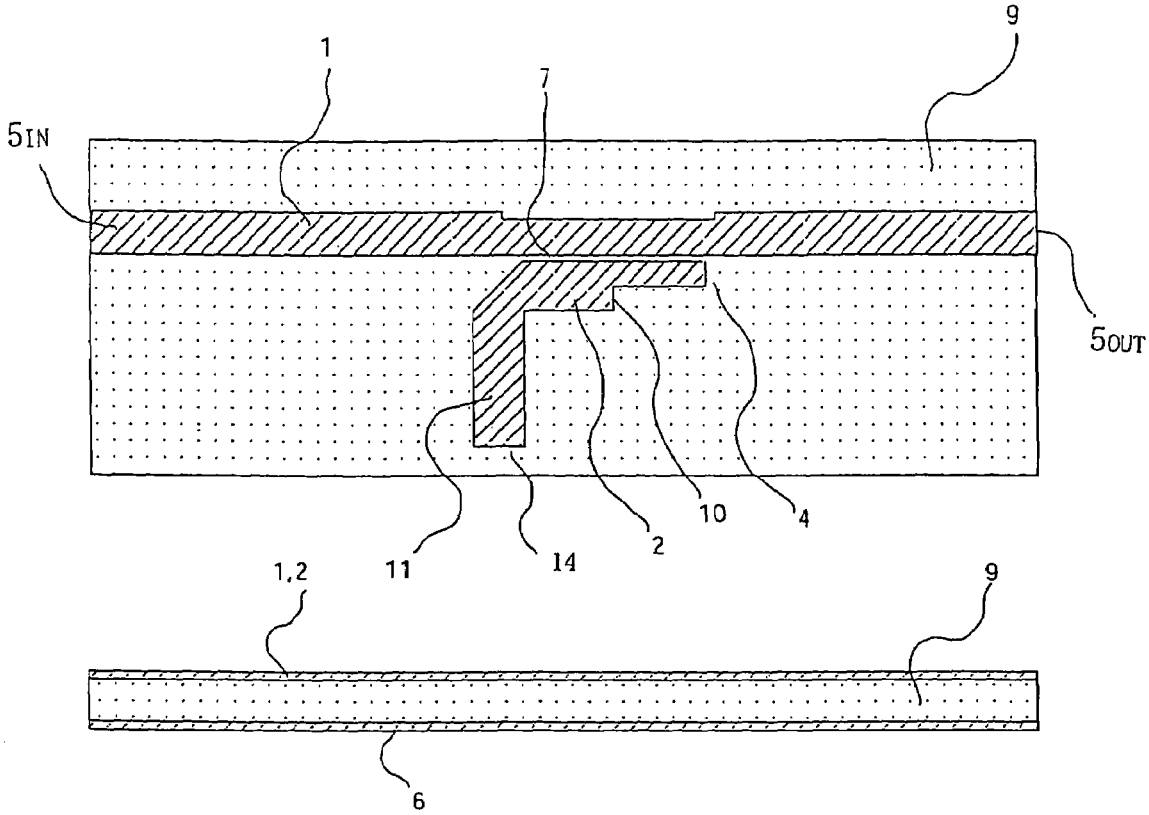
FIG. 6 is an internal construction diagram of a bandstop filter according to a second embodiment of the present invention.
Figure 7:
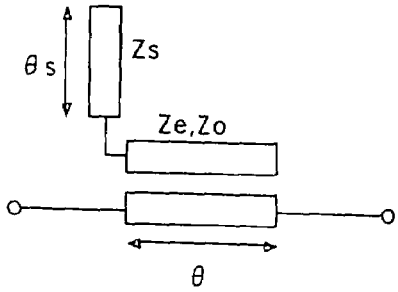
FIG. 7 is an equivalent circuit diagram of the bandstop filter according to the second embodiment of the present invention.

FIG. 6 is an internal construction diagram of a bandstop filter according to a second embodiment of the present invention, with a view from above and a cross-sectional view being illustrated. Also, FIG. 7 is an equivalent circuit diagram of the bandstop filter according to the second embodiment of the present invention. The fundamental structure is the same as that of the bandstop filter in the first embodiment. The second embodiment differs from the bandstop filter in the first embodiment in the following two points. That is, the number of stages of the filter is reduced to one and a tip-end open transmission line 11 having an approximately ¼ wavelength is used in place of the short-circuiting means.

The bandstop filter of the second embodiment performs fundamentally the same operation as in the first embodiment. The tip-end open transmission line 11 having the approximately ¼ wavelength is used in place of the short-circuiting means and is placed under an open state by an open end 14. In this state, the wavelength of the resonator at the center frequency of the stop band changes from the ¼ wavelength to a ½ wavelength. In addition, the through hole for constructing the short-circuiting means becomes unnecessary, production becomes easy, and there occurs no variation in characteristics due to a production error concerning the short-circuiting means 3, such as an error of the diameter of the through hole 8 or an error of the positional relation between the through hole 8 and the strip conductor 2 of the resonator, in theory.

When the resonator is changed from the ¼ wavelength to the ½ wavelength, the joint amount that is required between the main line and the resonator is increased as compared with the case where the ¼ wavelength resonator is used. This is because the frequency characteristics of the reactance of the resonator become steep. Therefore, it becomes necessary to reduce the width of the joint slit 7 in accordance with the joint amount, which leads to a case where production becomes difficult due to a production limitation as to the minimum conductor distance. In other words, it is difficult to realize a filter having an enlarged stop bandwidth through reduction of the width of the joint slit 7. In the bandstop filter of the second embodiment, the physical length of the line joint portion is enlarged by providing an impedance non-continuous structure portion 10 for the line joint portion, which makes it possible to make up for a shortage of the joint amount. As a result, it becomes possible to enlarge the width of the joint slit 7.

With the structure of the bandstop filter of the second embodiment, the short-circuiting means using a through hole or the like becomes unnecessary, which prevents variation in characteristics due to a production error as to the short-circuiting means and facilitates production. In addition, as compared with the ¼ wavelength resonator, the ½ wavelength resonator requires a large joint amount between the main line and the resonator. In the present invention, however, the impedance non-continuous structure portion is provided for the line joint portion, which makes it possible to enlarge the joint amount without narrowing the joint slit. As a result, an effect is provided that it is possible to realize a bandstop filter using a ½ wavelength resonator with ease. In addition, the necessity to narrow the joint slit than necessary is eliminated, which improves the production yield.

Third Embodiment

Figure 8:
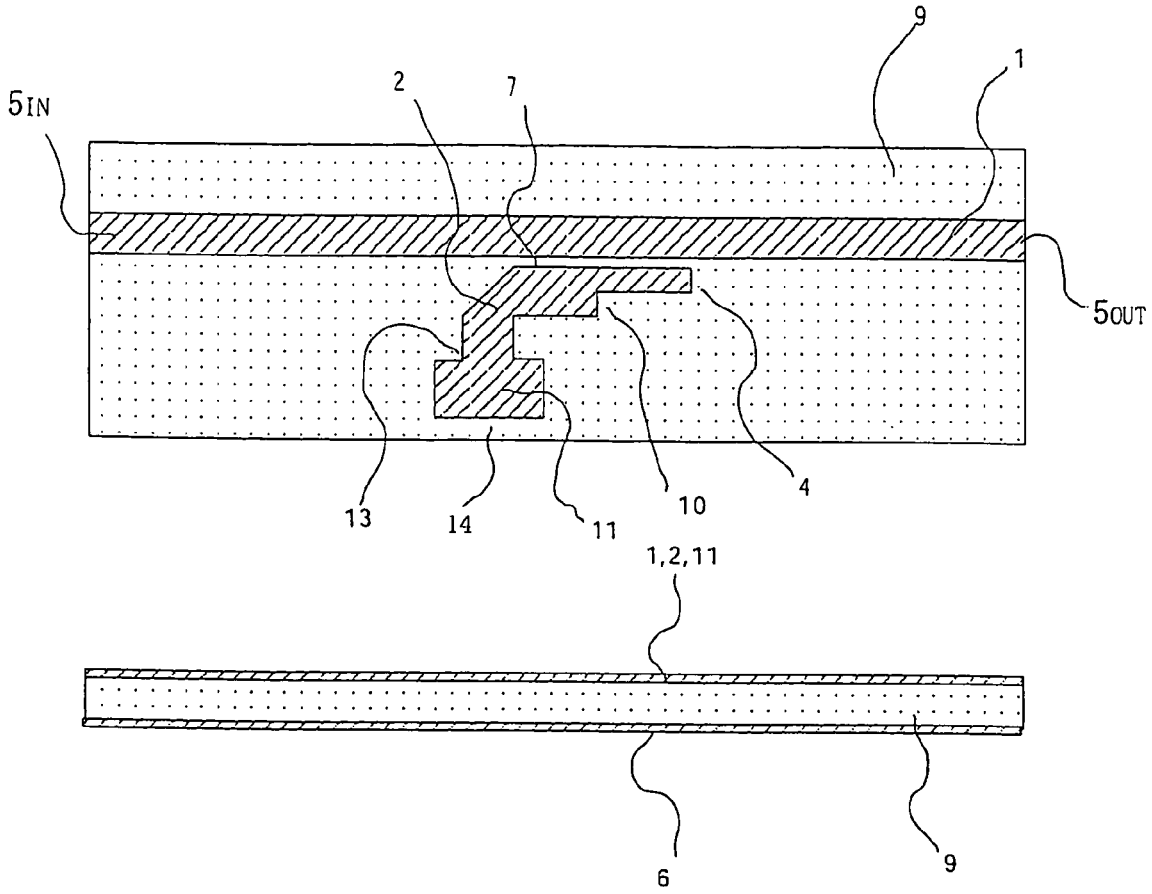
FIG. 8 is an internal construction diagram of a bandstop filter according to a third embodiment of the present invention.
Figure 9:
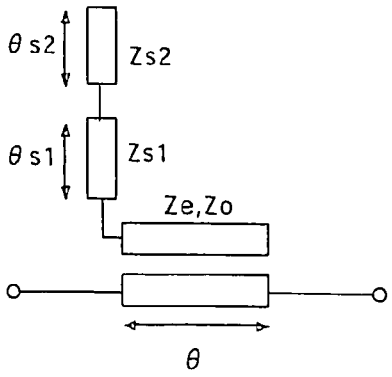
FIG. 9 is an equivalent circuit diagram of the bandstop filter according to the third embodiment of the present invention.

FIG. 8 is an internal construction diagram of a bandstop filter according to a third embodiment of the present invention, with a view from above and a cross-sectional view being illustrated. Also, FIG. 9 is an equivalent circuit diagram of the bandstop filter according to the third embodiment of the present invention. The fundamental structure is the same as that of the bandstop filter in the second embodiment. The third embodiment differs from the bandstop filter in the second embodiment in that an impedance non-continuous structure portion 13 is provided for the tip-end open transmission line 11 in the second embodiment.

The bandstop filter of the third embodiment performs fundamentally the same operation as in the second embodiment and provides fundamentally the same effect as in the second embodiment. In the bandstop filter of the third embodiment, the second impedance non-continuous structure portion 13 is provided for the tip-end open transmission line 11 that is a part of a ½ wavelength resonator. The impedance Zs2 of any electrical length ⊖s2 of the tip end portion of the tip-end open transmission line 11 is set lower than the impedance Zs1 of an electrical length ⊖s1 of the portion on a main line side of the tip-end open transmission line 11. With this construction including the second impedance non-continuous structure portion 13, the overall electrical length of the tip-end open transmission line 11 is reduced, which provides an effect that it is possible to obtain a compact filter.

Fourth Embodiment

Figure 10:
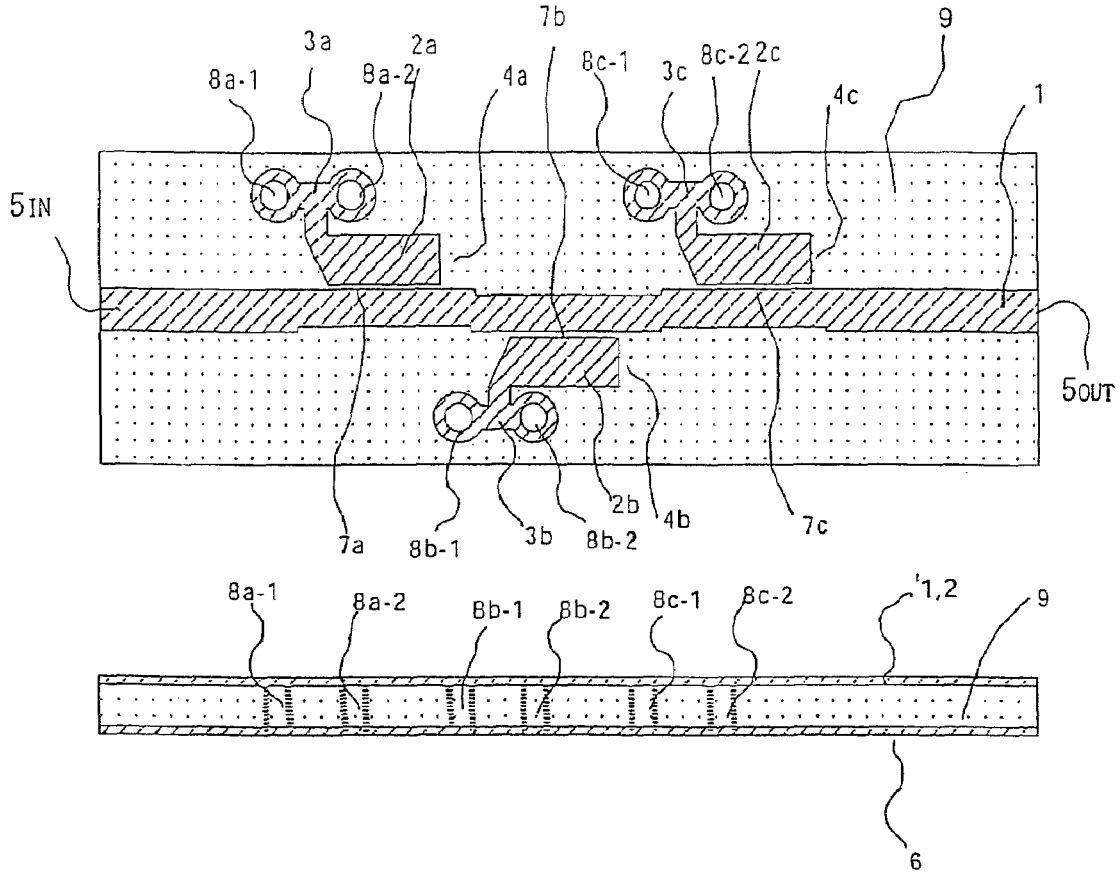
FIG. 10 is an internal construction diagram of a bandstop filter according to a fourth embodiment of the present invention.
Figure 11:
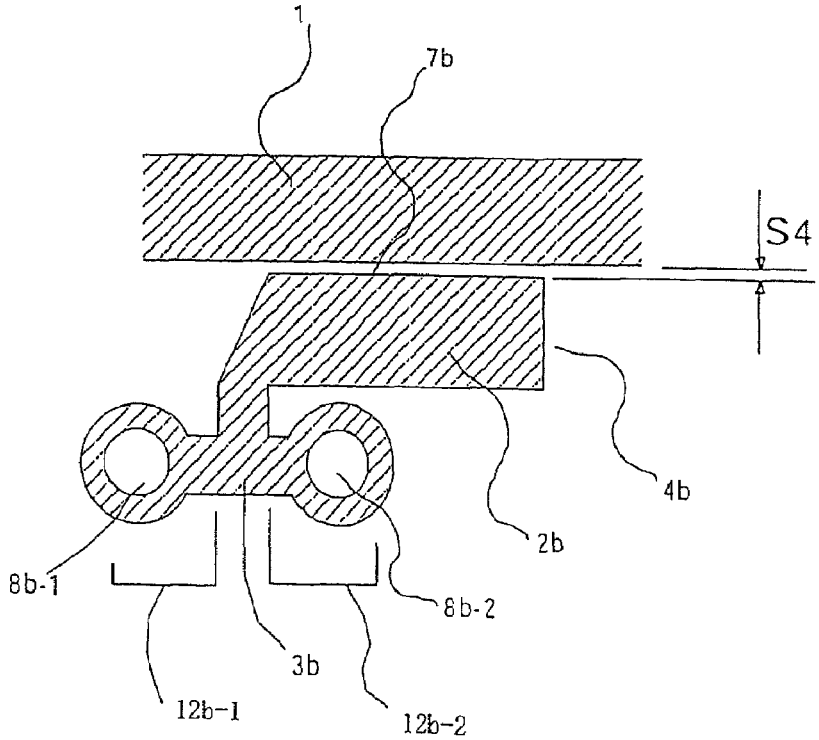
FIG. 11 is an enlarged view of a resonator in the second stage of the bandstop filter according to the fourth embodiment of the present invention.

FIG. 10 is an internal construction diagram of a bandstop filter according to a fourth embodiment of the present invention, with a view from above and a cross-sectional view being illustrated. Also, FIG. 11 is an enlarged view of a resonator in the second stage of the bandstop filter according to the fourth embodiment of the present invention. The fundamental structure is analogous to that of the bandstop filter in the first embodiment, but there are the following two points of difference. That is, in the fourth embodiment, the impedance non-continuous structure portion 10 is not provided and the structure of the short-circuiting means 3 is changed.

In the bandstop filter of the fourth embodiment, two short stubs extend from each strip connector 2*a*, 2*b* and 2*c*. The two short stubs that extend from 2*a* are labeled 8*a*-1 and 8*a*-2. The two short stubs that extend from 2*b* are labeled 8*b*-1 and 8*b*-2. The two short stubs that extend from 2*c* are labeled 8*c*-1 and 8*c*-2. The two short stubs that extend from 2*b* are illustrated in more detail in FIG. 11.

In the bandstop filter of the fourth embodiment shown in FIG. 11, two short stubs 12*b*-1 and 12*b*-2 (FIG. 11) constructed using through holes 8*b*-1 and 8*b*-2 and having short electrical lengths are arranged to oppose each other and are connected to each other. In addition, the two short stubs 12*b*-1 and 12*b*-2 are connected to a line joint portion between the main line and the resonator through a short transmission line.

With such a structure, as will be described below, an effect is provided that even when the positional relation of the two through holes to the conductor pattern varies due to a production error, variation in resonator resonance frequency is suppressed to minimum and variation in filter characteristics is reduced. The reason why the variation in resonance frequency is small even when the positions of the through holes with respect to the conductor pattern change is that the characteristics of the short-circuiting means are determined by the sum of the characteristics of the two short stubs 12*b*-1 and 12*b*-2. For instance, when the positions of the through holes are displaced in the horizontal direction in FIG. 11, one short stub 12*b*-1 (or 12*b*-2) is elongated but the other short stub 12*b*-2 (or 12*b*-1) is shortened, which results in a situation where characteristic variations cancel out each other. Also, when the positions of the through holes are displaced in the vertical direction in FIG. 11, this is a displacement in a direction orthogonal to the length direction of the short stubs 12*b*-1 and 12*b*-2, so no significant change occurs to the electrical lengths of the short stubs 12*b*-1 and 12*b*-2. Therefore, even when the positions of the through holes 8 are displaced, the variation in characteristics is suppressed, which improves the production yield.

Fifth Embodiment

Figure 12:
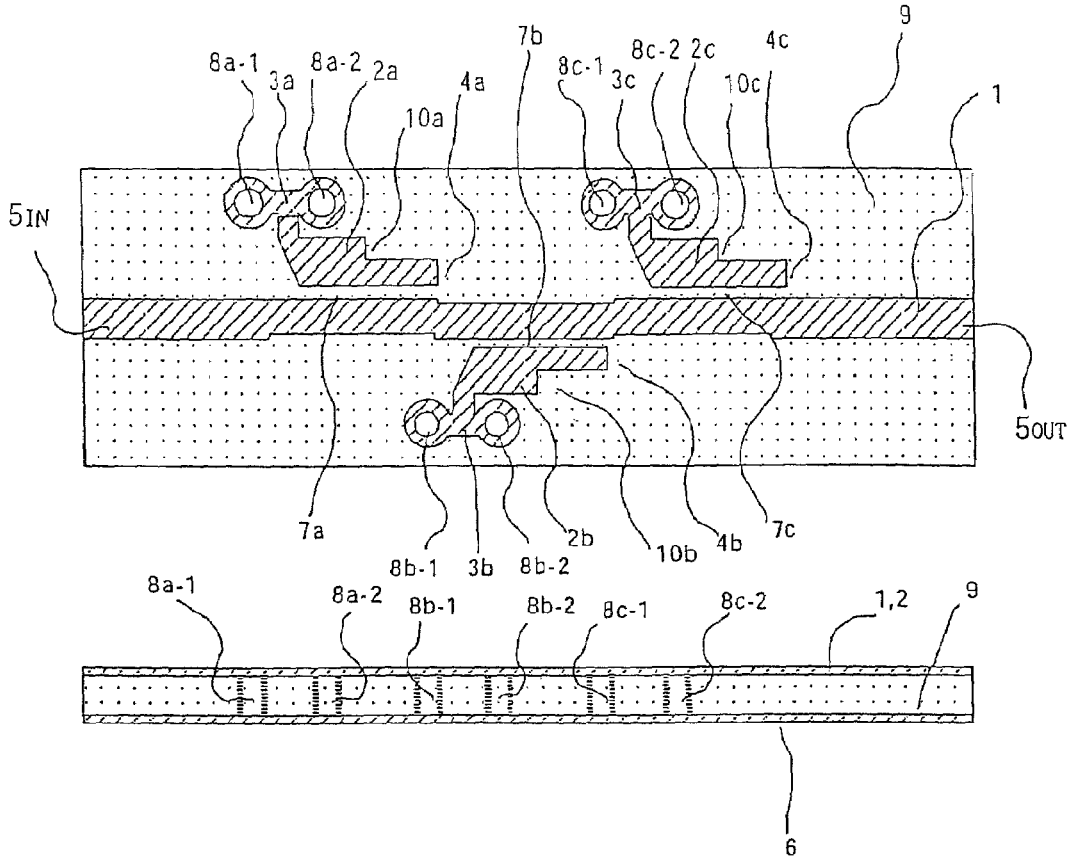
FIG. 12 is an internal construction diagram of a bandstop filter according to a fifth embodiment of the present invention.
Figure 13:
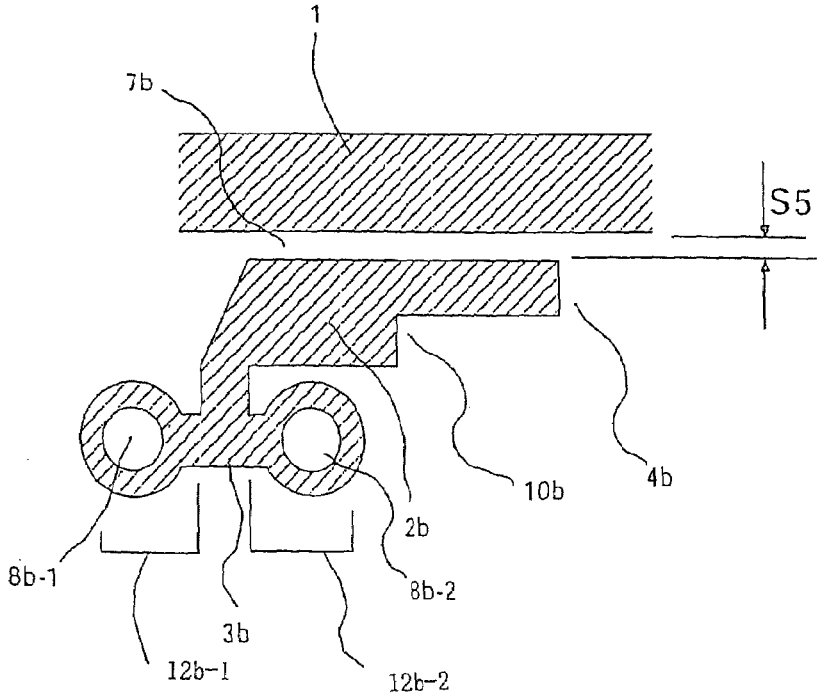
FIG. 13 is an enlarged view of a resonator in the second stage of the bandstop filter according to the fifth embodiment of the present invention.

FIG. 12 is an internal construction diagram of a bandstop filter according to a fifth embodiment of the present invention, with a view from above and a cross-sectional view being illustrated. Also, FIG. 13 is an enlarged view of a resonator in the second stage of the bandstop filter according to the fifth embodiment of the present invention. The bandstop filter of the fifth embodiment has a fundamental structure 10(*x*) in which the impedance non-continuous structure portion 10(*b*) used in the bandstop filter in the first embodiment is applied to the bandstop filter in the fourth embodiment.

The bandstop filter of the fifth embodiment provides the same effect as the bandstop filter in the first embodiment. In addition, like in the case of the bandstop filter in the fourth embodiment, the bandstop filter of the fifth embodiment provides an effect that variation in characteristics ascribable to positional displacements of the through holes with respect to the conductor pattern is reduced. When the short stubs 12*b*-1 and 12*b*-2, (FIG. 13) are used as the short-circuiting means 3*b* like in the fourth embodiment, the structure of the short-circuiting means 3*b* increases in size, so it becomes inevitable to arrange the short-circuiting means 3*b* at a position spaced apart from the strip conductor 1 of the main line due to a restriction under a production rule. Consequently, the inductance of the short-circuiting means 3*b* is increased, so it becomes necessary to shorten the physical length of the line joint portion that establishes a joint between the main line and the resonator. When the physical length of the line joint portion is shortened, the joint slit 7*b* becomes small and the stop bandwidth of the filter is limited.

In the bandstop filter of the fifth embodiment, two short stubs extend from each strip connector 2*a*, 2*b* and 2*c*. The two short stubs that extend from 2*a* are labeled 8*a*-1 and 8*a*-2. The two short stubs that extend from 2*b* are labeled 8*b*-1 and 8*b*-2. The two short stubs that extend from 2*c* are labeled 8*c*-1 and 8*c*-2. The two short stubs that extend from 2*b* are illustrated in more detail in FIG. 13. Additionally, with the physical length of the line joint portion shortened, the effect of making up for a shortage joint amount is accomplished with the impedance non-continuous structure 10*a*, 10*b* and 10*c*.

Therefore, when the short stubs 12*b*-1 and 12*b*-2 described in the fifth embodiment and the fourth embodiment are used as the short-circuiting means 3*b*, the effect of making up for a shortage of the joint amount with the impedance non-continuous structure portion 10(*b*) is increased. When it is assumed that the same stop bandwidth is realized, the dimensions S4 and S5 of the slit joint portion 7*b* shown in FIGS. 11 and 13, respectively, greatly differ from each other. That is, it is possible to set S5 larger than S4, which results in a possibility of producing a bandstop filter having less variation in characteristics with ease. As a result, the production yield is improved.

It should be noted here that in the above embodiments, a filter having a microstrip line structure has been described, but it is of course possible to provide the same effect even when the filter is constructed using another line structure such as a strip line or a coplanar line.

INDUSTRIAL APPLICABILITY

As described above, according to the present invention, it becomes possible to obtain a bandstop filter with which variation in characteristics is suppressed to minimum and a production yield is improved.

What is claimed is:

1. A bandstop filter comprising:

a main line connecting an input terminal and an output terminal to each other; and a ¼ wavelength resonator arranged in proximity to the main line approximately parallel to the main line with a distance of an approximately ¼ wavelength, wherein the ¼ wavelength resonator has a construction, in which means for short-circuiting with an earth conductor is provided at one end of the ¼ wavelength resonator and an open end is provided at the other end of the ¼ wavelength resonator, includes a first impedance non-continuous structure portion that divides a line section that is approximately parallel to the main line into portions, and in the line section that is approximately parallel to the main line, a characteristic impedance in a line section on the open end side is set higher than a characteristic impedance in a line section on the short-circuiting means side.

2. A bandstop filter constructed using a planar-circuit-shaped line including a dielectric substrate, strip conductors, and at least one earth conductor, comprising:

a strip conductor of a main line connecting an input terminal and an output terminal to each other; and a strip conductor of a ¼ wavelength resonator arranged in proximity to the main line approximately parallel to the main line with a distance of an approximately ¼ wavelength, wherein the strip conductor of the ¼ wavelength resonator has a construction in which short-circuiting means for short-circuiting with said at least one earth conductor is provided at one end and an open end is provided at the other end; and the short-circuiting means includes two short stubs which each have a through-hole that electrically connects the strip conductor of the ¼ wavelength resonator and said at least one earth conductor to each other.

3. The bandstop filter according to claim 2, wherein the strip conductor of the ¼ wavelength resonator includes a first impedance non-continuous structure portion that divides a line section that is approximately parallel to the strip conductor of the main line into portions having different characteristic impedances.

4. A bandstop filter comprising:

a main line connecting an input terminal and an output terminal to each other; and a ¼ wavelength resonator arranged in proximity to the main line approximately parallel to the main line with a distance of an approximately ¼ wavelength, the ¼ wavelength resonator has a construction, in which a tip-end open approximately ¼ wavelength line is provided at one end of the ¼ wavelength resonator and an open end is provided at the other end of the ¼ wavelength resonator, includes a first impedance non-continuous structure portion that divides a line section that is approximately parallel to the main line into portions and in the line section that is approximately parallel to the main line, a characteristic impedance in a line section on the open end side is set higher than a characteristic impedance in a line section on the tip-end open approximately ¼ wavelength line side, wherein the tip-end open approximately ¼ wavelength line includes a second impedance non-continuous structure portion and in a line section of the tip-end open approximately ¼ wavelength line, a characteristic impedance in a line section on an open end side of the tip-end open approximately ¼ wavelength line is set lower than a characteristic impedance in a line section on the main line side thereof.

5. A bandstop filter comprising:

a main line connecting an input terminal and an output terminal to each other; and a ¼ wavelength resonator arranged in proximity to the main line approximately parallel to the main line with a distance of an approximately ¼ wavelength, wherein the ¼ wavelength resonator has a construction, in which a tip-end open approximately ¼ wavelength line is provided at one end of the ¼ wavelength resonator and an open end is provided at the other end of the ¼ wavelength resonator, includes a first impedance non-continuous structure portion that divides a line section that is approximately parallel to the main line into portions and in the line section that is approximately parallel to the main line, a characteristic impedance in a line section on the open end side is set higher than a characteristic impedance in a line section on the tip-end open approximately ¼ wavelength line side.

* * * * *